US012448106B2

(12) United States Patent
Kuribayashi et al.

(10) Patent No.: US 12,448,106 B2
(45) Date of Patent: Oct. 21, 2025

(54) GATE RUDDER INCLUDING LEFT RUDDER AND RIGHT RUDDER DISPOSED LEFT AND RIGHT OF PROPELLER OF SHIP

(71) Applicants: KAY SEVEN CO., LTD., Tokyo (JP); Noriyuki Sasaki, Kanagawa (JP); KAMOME PROPELLER CO., LTD., Kanagawa (JP)

(72) Inventors: Sadatomo Kuribayashi, Tokyo (JP); Noriyuki Sasaki, Kanagawa (JP)

(73) Assignee: KAY SEVEN CO., LTD., Tokyo (JP)

( * ) Notice: Subject to any disclaimer, the term of this patent is extended or adjusted under 35 U.S.C. 154(b) by 621 days.

(21) Appl. No.: 17/912,467

(22) PCT Filed: Mar. 15, 2021

(86) PCT No.: PCT/JP2021/010375
§ 371 (c)(1),
(2) Date: Sep. 16, 2022

(87) PCT Pub. No.: WO2021/187418
PCT Pub. Date: Sep. 23, 2021

(65) Prior Publication Data

US 2023/0166825 A1 Jun. 1, 2023

(30) Foreign Application Priority Data

Mar. 19, 2020 (JP) ..... 2020-049646

(51) Int. Cl.
*B63H 25/06* (2006.01)
*B63H 25/38* (2006.01)

(52) U.S. Cl.
CPC ..... *B63H 25/38* (2013.01); *B63H 2025/066* (2013.01)

(58) Field of Classification Search
CPC ..... B63H 25/06; B63H 2025/063; B63H 2025/066; B63H 5/14; B63H 5/15;
(Continued)

(56) References Cited

U.S. PATENT DOCUMENTS 3,872,817 A * 3/1975 Duryea ..... B63H 25/06 114/163
4,895,093 A 1/1990 Dalsbo
(Continued)

FOREIGN PATENT DOCUMENTS

EP 1394037 A1 3/2004
JP H01501384 A 5/1989
(Continued)

OTHER PUBLICATIONS

International Search Report for PCT/JP2021/010375, Mailed May 25, 2021, 2 pages.

*Primary Examiner* — Andrew Polay
(74) *Attorney, Agent, or Firm* — Lippes Mathias LLP

(57) ABSTRACT

To provide a gate rudder capable of reducing energy consumption during a voyage of a ship.

A gate rudder including a pair of rudders including a left rudder and a right rudder disposed left and right, respectively, of a propeller at a stern, wherein each of the rudders includes a first rudder portion extending in a horizontal direction and a second rudder portion linearly extending in a vertical direction in rear view, wherein a rudder chord length of the second rudder portion in a front-rear direction is 40 to 100% of a diameter of the propeller, wherein the propeller is provided within a range of 15 to 65% of the rudder chord length from a front edge of the second rudder portion in side view, and wherein a rudder shaft that drives each of the rudders is provided at a position within a range
(Continued)

of 30 to 50% of the rudder chord length from the front edge of the second rudder portion in side view.

13 Claims, 18 Drawing Sheets

(58) Field of Classification Search
CPC .... B63H 25/38; B63H 25/381; B63H 25/382; B63H 25/383; B63H 25/384; B63H 2025/384; B63H 2025/385; B63H 2025/386; B63H 2025/387; B63H 2025/388
See application file for complete search history.

(56) References Cited

U.S. PATENT DOCUMENTS

| | | | | | |
|---|---|---|---|---|---|
| 5,456,200 | A * | 10/1995 | Shen | ..... | B63H 25/38 114/162 |
| 2004/0163579 | A1* | 8/2004 | Tomita | ..... | B63H 25/38 114/163 |
| 2017/0081010 | A1* | 3/2017 | Kuribayashi | ..... | B63H 25/38 |
| 2024/0010319 | A1* | 1/2024 | Kuribayashi | ..... | B63H 25/38 |

FOREIGN PATENT DOCUMENTS

| | | | | | |
|---|---|---|---|---|---|
| JP | 09-066895 | A | | 3/1997 | |
| JP | 5833278 | B1 | | 11/2015 | |
| JP | 201616777 | A | | 2/2016 | |
| JP | 2016188033 | A | | 11/2016 | |
| JP | 201934709 | A | | 3/2019 | |
| KR | 20220074456 | A | * | 6/2022 | ..... B63H 25/26 |

* cited by examiner

Cp=0. 3

Cp=0.5

Cp=0.7

GATE RUDDER INCLUDING LEFT RUDDER AND RIGHT RUDDER DISPOSED LEFT AND RIGHT OF PROPELLER OF SHIP

TECHNICAL FIELD

The present invention relates to a gate rudder including a left rudder and a right rudder disposed left and right, respectively, of a propeller provided at the stern of a ship.

BACKGROUND ART

In the related art, there is known a technique of a gate rudder in which a left rudder and a right rudder extending in the front-rear direction with a predetermined distance are provided left and right, respectively, of a propeller provided at the stern of a ship, and the left rudder and the right rudder are moved behind the propeller when the ship is stopped. (Patent Literature 1)

In addition, there is known a technique of a ducted propeller in which in order to accelerate the jet ejected from the propeller, a left rudder and a right rudder are provided left and right, respectively, of the propeller in an arc shape along the outer peripheral portion of the propeller. (Patent Literature 2)

CITATION LIST

Patent Literature

Patent Literature 1: JP 5833278 B1
Patent Literature 2: JP 1-501384 A

SUMMARY OF INVENTION

Technical Problem

However, the technique of Patent Literature 1 has a problem that sufficient rudder force due to the Coanda effect and the upper surface blowing (hereinafter, it is referred to as a USB.) effect used in a high lift device of an aircraft cannot be obtained when the ship travels straight, and energy consumption during the voyage of the ship cannot be sufficiently reduced. In addition, due to the particularity of steering the rudder behind the propeller, a large torque is generated, and substantially the same capacity of the steering machine as in the related art is required although the area of the rudder is smaller than that in the related art.

In addition, in the technique of Patent Literature 2, the clearance between the propeller and the left and right rudders is set to be small in order to increase the efficiency of the propeller, so that there is a problem that cavitation erosion easily occurs on the inner faces of the left and right rudders.

Therefore, a main object of the present invention is to provide a gate rudder capable of reducing energy consumption during a voyage of a ship. In addition, a next object of the present invention is to provide a gate rudder capable of suppressing the occurrence of cavitation erosion occurring on the inner faces of the left and right rudders. Furthermore, an object is to optimize the capacity of the steering machine to a size corresponding to a small rudder area.

Solution to Problem

The present invention that has solved the above problems is as follows.

The invention recited in claim 1 is a gate rudder including a pair of rudders including a left rudder and a right rudder disposed left and right, respectively, of a propeller at a stern, wherein each of the rudders includes a first rudder portion extending in a horizontal direction and a second rudder portion linearly extending in a vertical direction in rear view, wherein a rudder chord length of the second rudder portion in a front-rear direction is 40 to 100% of a diameter of the propeller, wherein the propeller is provided within a range of 15 to 65% of the rudder chord length from a front edge of the second rudder portion in side view, and wherein a rudder shaft that drives each of the rudders is provided at a position within a range of 30 to 50% of the rudder chord length from the front edge of the second rudder portion in side view.

The invention recited in claim 2 is the gate rudder according to claim 1, wherein the rudder shaft that drives each of the rudders is provided at a position within a range of 35 to 45% of the rudder chord length from the front edge of the second rudder portion in side view.

The invention recited in claim 3 is the gate rudder according to claim 1 or 2, wherein a clearance between the propeller and the second rudder portion is 4 to 10% of the diameter of the propeller in rear view.

The invention recited in claim 4 is the gate rudder according to any one of claims 1 to 3, wherein the second rudder portion is distorted, and has an upper torsion angle formed in an upper portion of the second rudder portion and a lower torsion angle formed in an upper portion of the second rudder portion, and the upper torsion angle is larger than the lower torsion angle.

The invention recited in claim 5 is the gate rudder according to claim 4, wherein the upper torsion angle is 3 degrees or more, and the lower torsion angle is 5 degrees or less.

The invention recited in claim 6 is the gate rudder according to any one of claims 1 to 5, wherein the second rudder portion is steered forward when a ship is stopped.

Advantageous Effects of Invention

According to the invention recited in claim 1, the rudder includes a first rudder portion extending in a horizontal direction and a second rudder portion linearly extending in a vertical direction in rear view, a rudder chord length of the second rudder portion in a front-rear direction is 40 to 100% of a diameter of the propeller, wherein the propeller is provided within a range of 15 to 65% of the rudder chord length from a front edge of the second rudder portion in side view, and a rudder shaft that drives the rudder is provided at a position within a range of 30 to 50% of the rudder chord length from the front edge of the second rudder portion in side view, so that when the ship travels straight, by a large rudder force due to the Coanda effect generated at the front portion of the second rudder portion of the rudder and a large rudder force due to the USB effect generated at the rear portion, a large thrust force that moves the ship forward can be generated to reduce energy consumption during a voyage of the ship, and at the same time, minimization of the rudder torque can be achieved.

According to the invention recited in claim 2, in addition to the effect of the invention described in claim 1, the rudder shaft that drives the rudder is provided at a position within a range of 35 to 45% of the rudder chord length from the front edge of the second rudder portion in side view, so that a larger rudder force can be generated when the second rudder portion is steered forward, and at the same time, the rudder torque can be further minimized.

According to the invention recited in claim 3, in addition to the effect of the invention of claim 1 or 2, a clearance between the propeller and the second rudder portion is 4 to 10% of the diameter of the propeller in rear view, so that it is possible to maintain a large rudder force due to the USB effect generated at the rear portion of the second rudder portion and to prevent the occurrence of cavitation erosion on the inner face of the second rudder shaft.

According to the invention recited in claim 4, in addition to the effect of the invention described in any one of claims 1 to 3, the second rudder portion is distorted, and has an upper torsion angle formed in an upper portion of the second rudder portion and a lower torsion angle formed in an upper portion of the second rudder portion, and the upper torsion angle is larger than the lower torsion angle, so that a larger thrust can be generated at the upper portion of the second rudder portion facing a shallow portion of a draft of a ship in which a flow velocity of a suction flow flowing to a propeller is high and energy consumption during the voyage of the ship can be further reduced.

According to the invention recited in claim 5, in addition to the effect of the invention described in any one of claims 1 to 4, the upper torsion angle is 3 degrees or more, and the lower torsion angle is 5 degrees or less, so that it is possible to reduce energy consumption during the voyage of ships from a thin ship such as a container ship to a thick ship such as a tanker.

According to the invention recited in claim 6, in addition to the effect of the invention described in any one of claims 1 to 4, the second rudder portion is steered forward when the ship is stopped, so that the stop distance of the ship can be shortened by a large rudder force generated at the second rudder portion when the ship is stopped.

DESCRIPTION OF EMBODIMENTS

Figure 1:
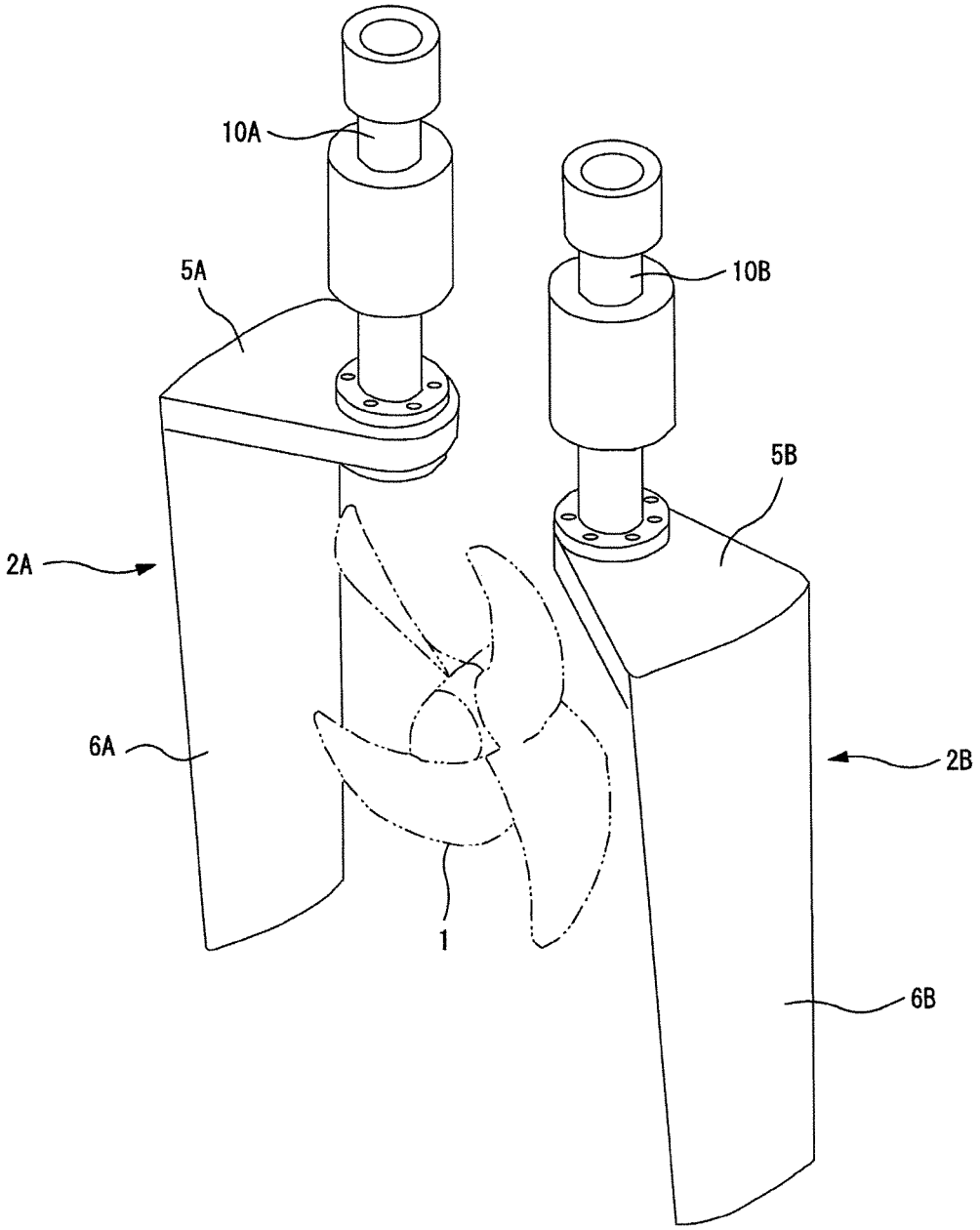
FIG. 1 is a perspective view of a gate rudder including a left rudder and a right rudder left and right, respectively, of a propeller.

As illustrated in FIG. 1, the rudder (hereinafter, referred to as a gate rudder.) of the present embodiment includes a left rudder 2A and a right rudder 2B disposed left and right, respectively, of a propeller 1 of the ship.

The left rudder 2A includes a first left rudder portion 5A extending in the horizontal direction and a second left rudder portion 6A extending downward from the left end of the first left rudder portion 5A. Note that the left end of the first left rudder portion 5A and the upper portion of the second left rudder portion 6A can be connected by an inclined and gently curved connecting portion (not illustrated).

A left rudder shaft 10A extending in the vertical direction is fixed to the right portion of the first left rudder portion 5A, the upper portion of the left rudder shaft 10A extends into the engine room of the ship, and a left steering machine (not illustrated) that steers the left rudder shaft 10A is connected to the upper portion of the left rudder shaft 10A.

Similarly, the right rudder 2B includes a first right rudder portion 5B extending in the horizontal direction and a second right rudder portion 6B extending downward from the right end of the first right rudder portion 5B. Note that the left end of the first left rudder portion 5A and the upper portion of the second left rudder portion 6A can be connected by an inclined and gently curved connecting portion (not illustrated).

A right rudder shaft 10B extending in the vertical direction is fixed to the left portion of the first right rudder portion 5B, the upper portion of the right rudder shaft 10B extends into the engine room of the ship, and a rightward steering machine (not illustrated) that steers the right rudder shaft 10B is connected to the upper portion of the right rudder shaft 10B.

Note that, in the present specification, the left rudder 2A and the right rudder 2B are collectively referred to as a rudder 2, the first left rudder portion 5A and the first right rudder portion 5B are collectively referred to as a first rudder portion, the second left rudder portion 6A and the second right rudder portion 6B are collectively referred to as a second rudder portion 6, and the left rudder shaft 10A and the right rudder shaft 10B are collectively referred to as a rudder shaft.

<Rudder Chord Length of Second Rudder Portion>

Figure 2:
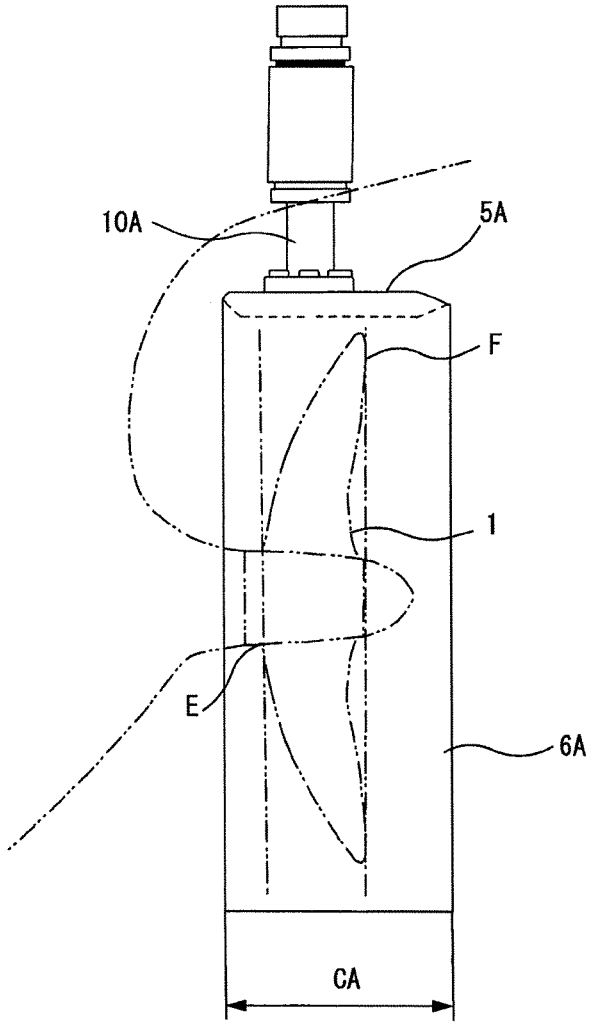
FIG. 2 is a left side view of the gate rudder.

As illustrated in FIG. 2, a left rudder chord length CA of the second left rudder portion 6A is preferably 40 to 100% of a diameter D of the propeller 1 as in the duct length of the ducted propeller. As a result, the rudder force can be efficiently obtained from the second left rudder portion 6A.

In addition, the propeller 1 is disposed within a range of 15 to 65% of the left rudder chord length CA from the front end portion of the second left rudder portion 6A, that is, the front end portion E of the blade portion of the propeller 1 is disposed behind a position of 15% of the left rudder chord length CA from the front end portion of the second left rudder portion 6A, and the rear end portion F of the blade portion of the propeller 1 is disposed forward of a position of 65% of the left rudder chord length CA from the front end portion of the second left rudder portion 6A.

Figure 3:
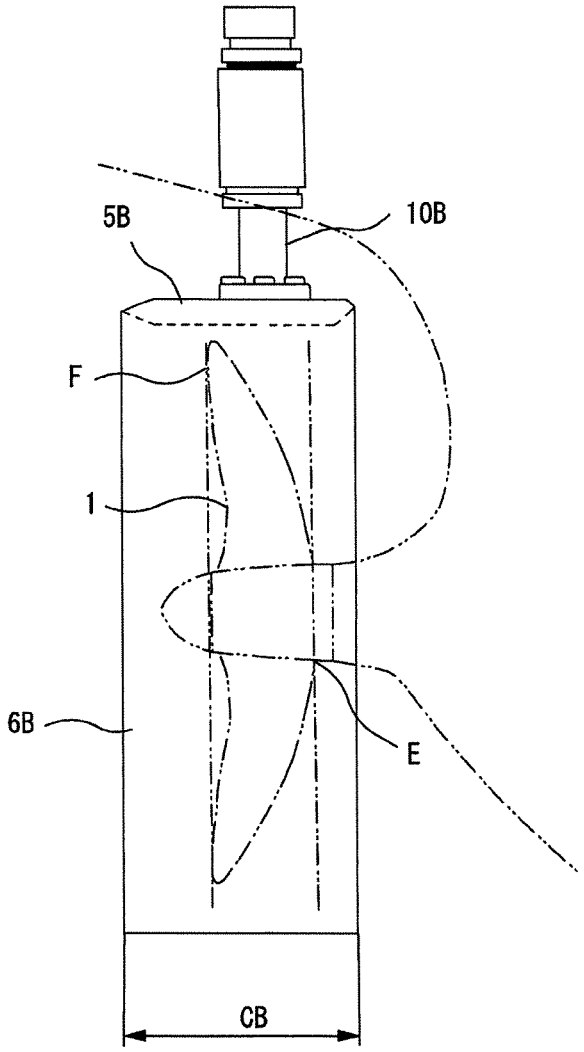
FIG. 3 is a right side view of the gate rudder.

Similarly, as illustrated in FIG. 3, a right rudder chord length CB of the second right rudder portion 6B is preferably 40 to 100% of the diameter D of the propeller 1. As a result, the rudder force can be efficiently obtained from the second right rudder portion 6B.

In addition, the propeller 1 is disposed within a range of 15 to 65% of the right rudder chord length CB from the front end portion of the second right rudder portion 6B, that is, the front end portion E of the blade portion of the propeller 1 is disposed behind a position of 15% of the right rudder chord length CB from the front end portion of the second right rudder portion 6B, and the rear end portion F of the blade portion of the propeller 1 is disposed forward of a position of 65% of the right rudder chord length CB from the front end portion of the second right rudder portion 6B.

In the present specification, the left rudder chord length CA and the right rudder chord length CB are collectively referred to as a rudder chord length C.

<Arrangement of Rudder Shaft>

The left rudder shaft 10A is preferably provided within a range of 30 to 50% of the left rudder chord length CA of the second left rudder portion 6A from the front edge of the second left rudder portion 6A, and the right rudder shaft 10B is preferably provided within a range of 30 to 50% of the right rudder chord length CB of the second right rudder portion 6B from the front edge of the second right rudder portion 6B. In addition, in order to generate a large rudder force at the time of forward steering, the left rudder shaft 10A is preferably provided within a range of 35 to 45% of the left rudder chord length CA of the second left rudder portion 6A from the front edge of the second left rudder portion 6A, and the right rudder shaft 10B is more preferably provided within a range of 35 to 45% of the right rudder chord length CB of the second right rudder portion 6B from the front edge of the second right rudder portion 6B. As a result, the torque for steering the left rudder shaft 10A and the right rudder shaft 10B can be reduced, and as described later, when the ship is stopped, it is also possible to suppress a decrease in the rudder force of the rear portions of the second left rudder portion 6A and the second right rudder portion 6B extending rearward of the propeller 1 when the ship goes straight.

The rudder force $F_N$ generated at the rear portion of the second rudder portion 6 extending rearward of the propeller 1 can be calculated by substituting the rudder force $F_{N1}$ generated at the rear portion of the second rudder portion 6 located outside the jet of the propeller 1 and the rudder force $F_{N2}$ generated at the rear portion of the second rudder portion 6 located in the jet of the propeller 1 into Equation 1.

$$F_N = F_{N1}\cdot(1-\mu)+\mu\cdot F_{N2} \quad \text{[Equation 1]}$$

$F_{N1}$ of Equation 1 can be calculated from Equation 2.

$$F_{N1} = \frac{1}{2}\rho U_{R1}^2 \Lambda_R C_{L1} \quad \text{[Equation 2]}$$

where, ρ is a density, $U_{R1}$ is a speed at a rudder position, $A_R$ is an area of a rear portion of the second left rudder portion 6A extending rearward of the propeller 1, and $C_{L1}$ is a lift coefficient.

$U_{R1}$ in Equation 2 can be calculated from Equation 3.

$$U_{R1}^2 = u_{R1}^2 + v_R^2 \quad \text{[Equation 3]}$$

where, $U_{R1}$ is a propeller axial component of the speed, and $V_R$ is a circumferential component of the speed.

$C_{L1}$ in Equation 2 can be calculated from Equation 4.

$$C_{L1} = \frac{6.23}{2.25+\lambda}\sin\left[\delta - \tan^{-1}\left(\frac{v_R}{u_{R1}}\right)\right] \quad \text{[Equation 4]}$$

where, λ represents an aspect ratio of the rudder, and δ represents a rudder angle.

$F_{N2}$ in Equation 1 can be calculated from Equation 5.

$$F_{N1} = \frac{1}{2}\rho U_{R2}^2 \Lambda_R C_{L2} \quad \text{[Equation 5]}$$

where, ρ is a density, $U_{R2}$ is a speed at a rudder position, $A_R$ is an area of a rear portion of the second rudder portion 6 extending rearward of the propeller 1, and $C_{L2}$ is a lift coefficient.

$U_{R2}$ in Equation 5 can be calculated from Equation 6.

$$U_{R2}^2 = u_{R2}^2 + v_R^2 \quad \text{[Equation 6]}$$

where, $U_{R2}$ is a propeller axial component of the speed, and $V_R$ is a circumferential component of the speed.

$C_{L2}$ in Equation 5 can be calculated from Equation 7.

$$C_{L2} = \frac{6.23}{2.25+\lambda}\sin\left[\delta - \tan^{-1}\left(\frac{v_R}{u_{R2}}\right)\right] \quad \text{[Equation 7]}$$

where, λ represents an aspect ratio of the rudder, and δ represents a rudder angle.

μ in Equation 1 can be calculated from Equation 8.

$$\mu = \frac{\Lambda_{cv}}{\Lambda_R \cdot \eta} \quad \text{[Equation 8]}$$

where, $A_{CV}$ is an area of the rear portion of the second rudder portion 6 located in the jet of the propeller 1, $A_R$ is an area of the rear portion of the second rudder portion 6 extending rearward of the propeller 1, and η is a ratio (D/H) of the diameter D of the propeller 1 to the height H of the rudder 2.

Figure 4:
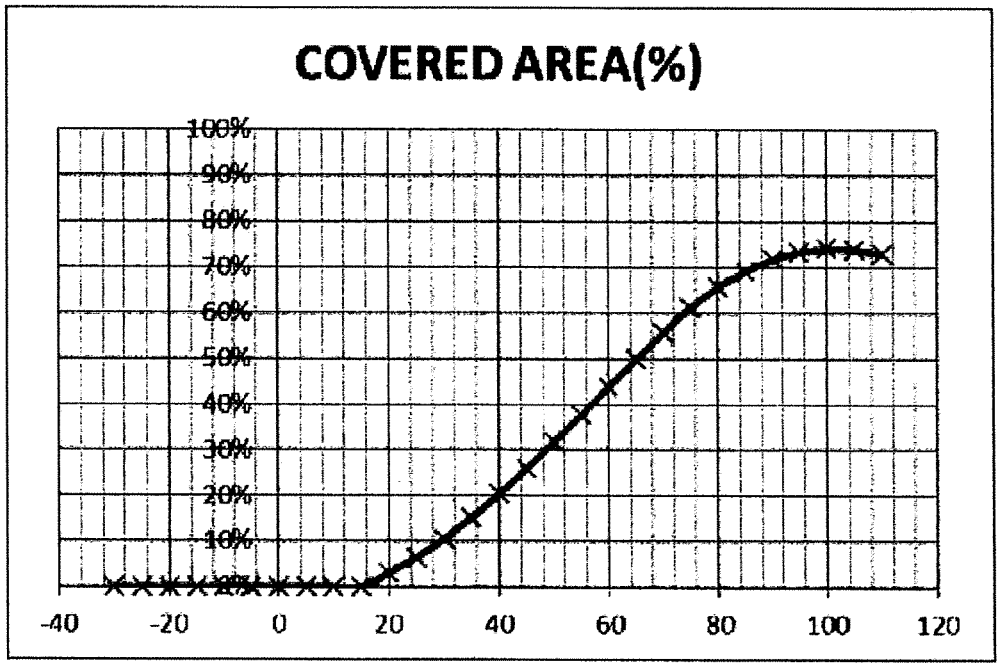
FIG. 4 is an area (percentage with respect to the entire area) of a rudder covered with a propeller wake when a rudder angle is taken in a case where a rudder shaft is provided at a position of 30% (Cp=0.3) of a rudder chord length from a front edge of the rudder.
Figure 5:
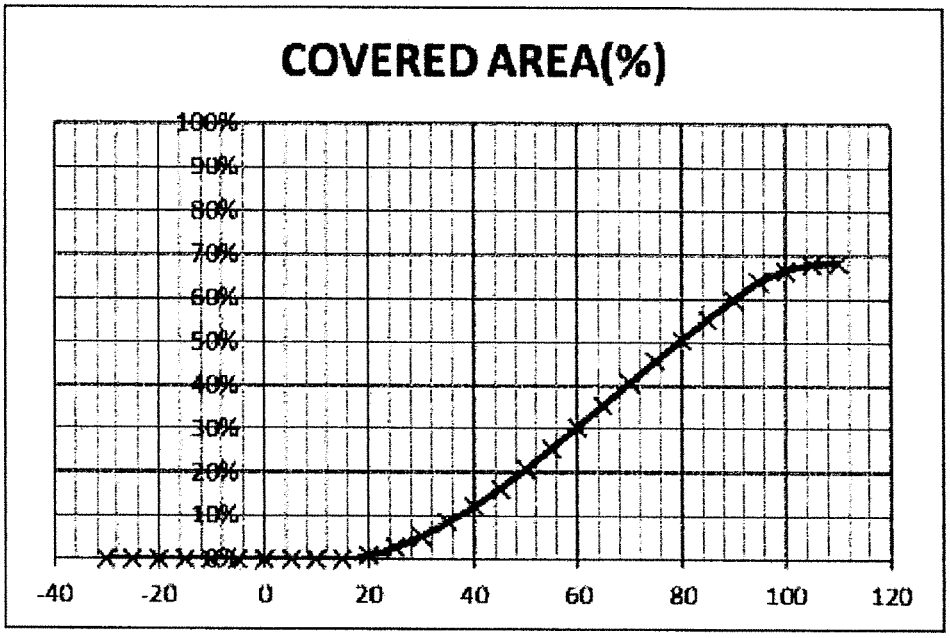
FIG. 5 is an area (percentage with respect to the entire area) of a rudder covered with a propeller wake when a rudder angle is taken in a case where a rudder shaft is provided at a position of 50% of a rudder chord length (Cp=0.5) from a front edge of the rudder.
Figure 6:
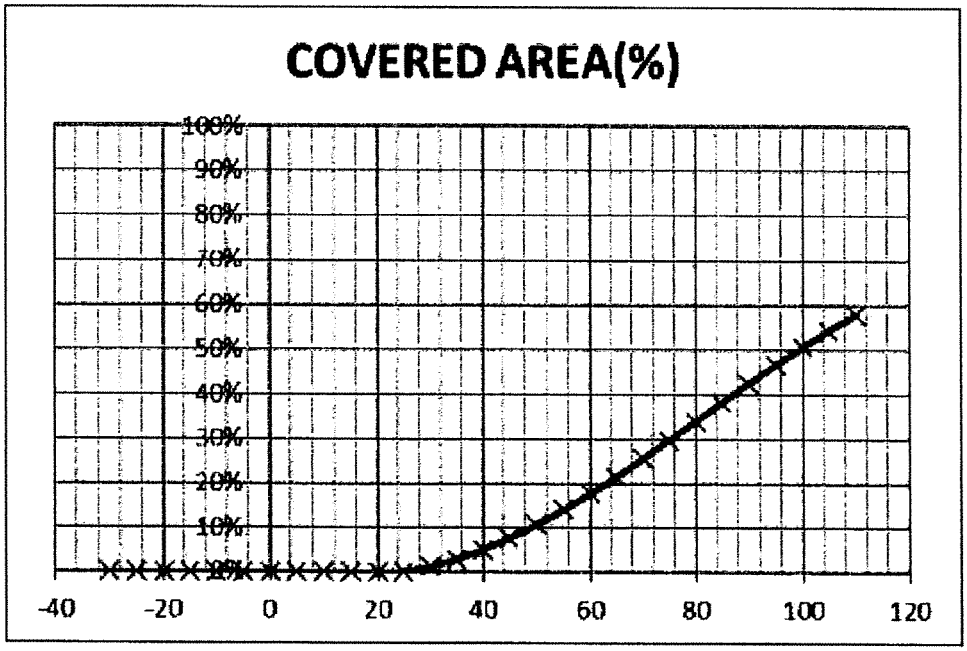
FIG. 6 is an area (percentage with respect to the entire area) of a rudder covered with a propeller wake when a rudder angle is taken in a case where a rudder shaft is provided at a position of 70% of a rudder chord length (Cp=0.7) from a front edge of the rudder.

As illustrated in FIGS. 4 to 6, when the rudder shaft 10 is provided behind a position of 50% (Cp=0.5) of the rudder chord length C of the second rudder portion 6 from the front edge of the second rudder portion 6 (for example, Cp=0.7), the area $A_{CV}$ of the rear portion of the second rudder portion 6 extending rearward of the propeller 1 in Equations 2 and 5 sharply decreases. As a result, there is a possibility that the rudder force $F_N$ generated at the rear portion of the second rudder portion 6 extending rearward of the propeller 1 due to the jet of the propeller 1 is excessively small. Therefore, in order to generate the predetermined rudder force $F_N$ at the rear portion of the second rudder portion 6 extending rearward of the propeller 1, the rudder shaft 10 is preferably provided with in a range of 50% or less of the rudder chord length C of the second rudder portion 6 from the front edge of the second rudder portion 6. In FIGS. 4 to 6, the area of the rear portion of the second rudder portion 6 is clearly indicated as COVERED AREA.

Figure 7:
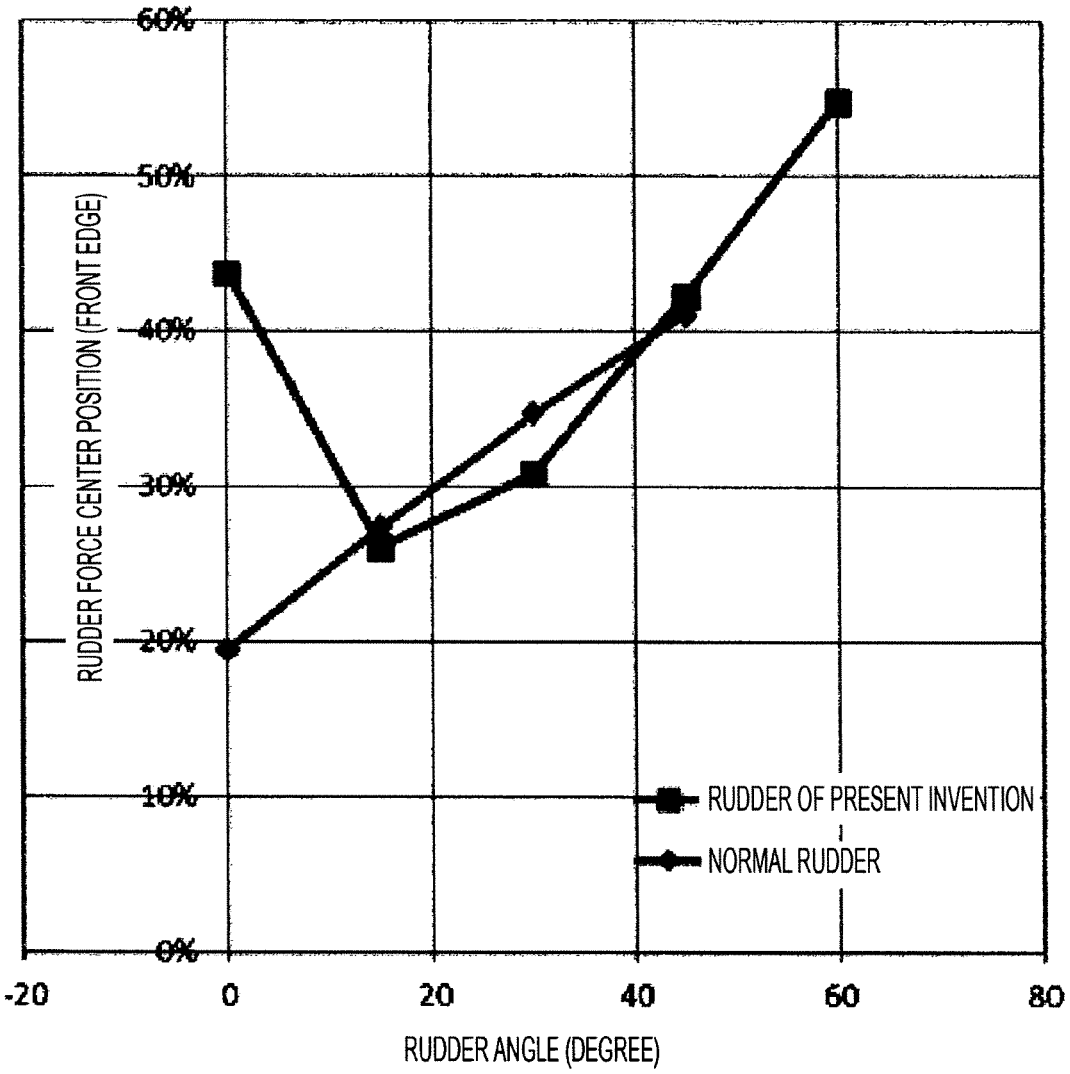
FIG. 7 is a measurement value of a rudder force center position when a rudder angle is changed from 0 to 60 degrees.

As illustrated in FIG. 7, when the steering machine is operated to change the rudder angle to 0 to 60 degrees, the acting center position (dimensionless value) of the rudder force monotonously changes to around 40% starting from 20% with an increase in the rudder angle in the normal rudder, whereas the acting center position of the rudder force decreases to around 25% starting from 45%, and then further increases to around 55% in the gate rudder. Therefore, in order to minimize the maximum steering torque, it is necessary to move the rudder shaft position from around 30% of the conventional position to around 40%. FIG. 7 shows the acting center position (dimensionless value) of the rudder force obtained from the water tank experiment in comparison with that of the normal rudder.

<Clearance Between Propeller and Rudder>

Figure 8:
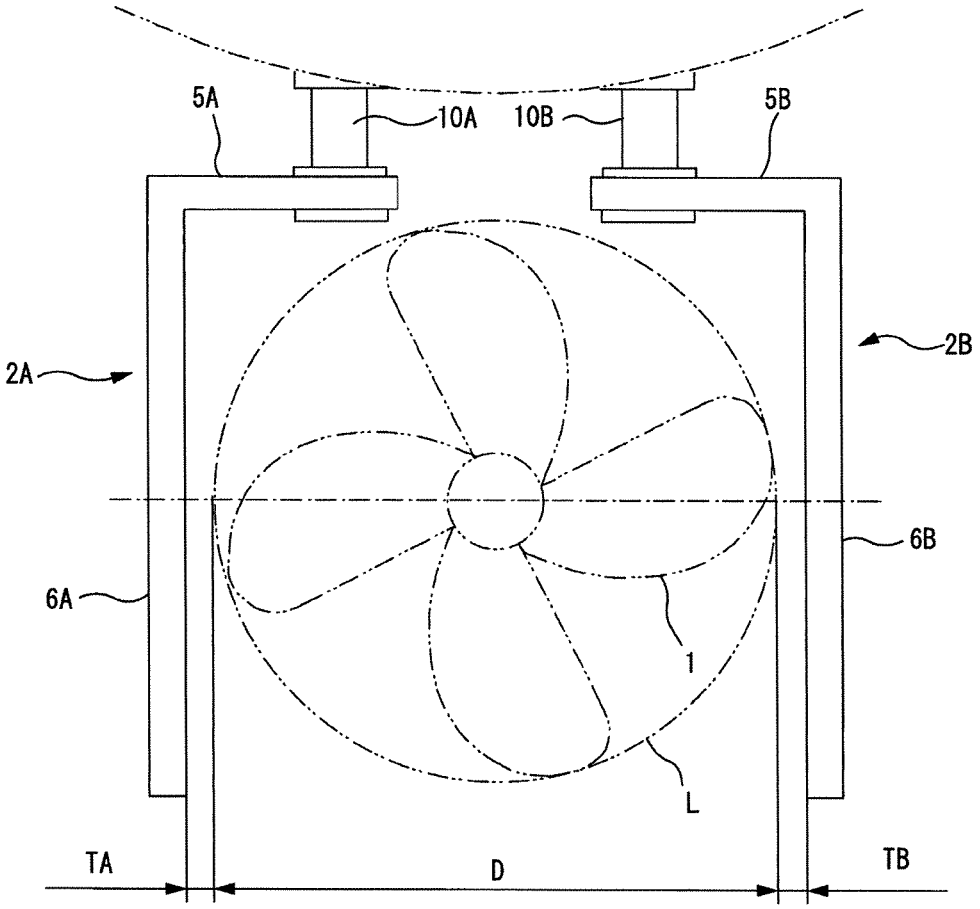
FIG. 8 is a rear view of the gate rudder.

As illustrated in FIG. 8, a left clearance TA between an outer peripheral line L of the propeller 1 and a left inner face 7A of the second left rudder portion 6A greatly affects a rudder force due to the Coanda effect generated in the front portion of the second left rudder portion 6A extending forward of the propeller 1 by the suction flow flowing to the propeller 1 by the suction force of the propeller 1 and a rudder force due to the USB effect generated in the rear portion of the second left rudder portion 6A extending rearward of the propeller 1 by the jet ejected from the propeller 1.

Similarly, a right clearance TB between the outer peripheral line L of the propeller 1 and a right inner face 7B of the second right rudder portion 6B greatly affects a rudder force due to the Coanda effect generated in the front portion of the second right rudder portion 6B extending forward of the propeller 1 by the suction flow flowing to the propeller 1 by the suction force of the propeller 1 and a rudder force due to the USB effect generated in the rear portion of the second right rudder portion 6B extending rearward of the propeller 1 by the jet ejected from the propeller 1.

That is, in a case where the left clearance TA and the right clearance TB are set to clearances less than a predetermined value, damage due to cavitation may occur on the inner faces of the left and right rudders, and in a case where the left clearance TA and the right clearance TB are set to clearances more than a predetermined value, the flow velocity of the suction flow and the flow velocity of the jet flow are reduced, and the Coanda effect and the USB effect are reduced, so that the rudder force may be reduced.

In the present specification, the left inner face 7A and the right inner face 7B are collectively referred to as an inner face 7, and the left clearance TA and the right clearance TB are collectively referred to as a clearance T.

Figure 9:
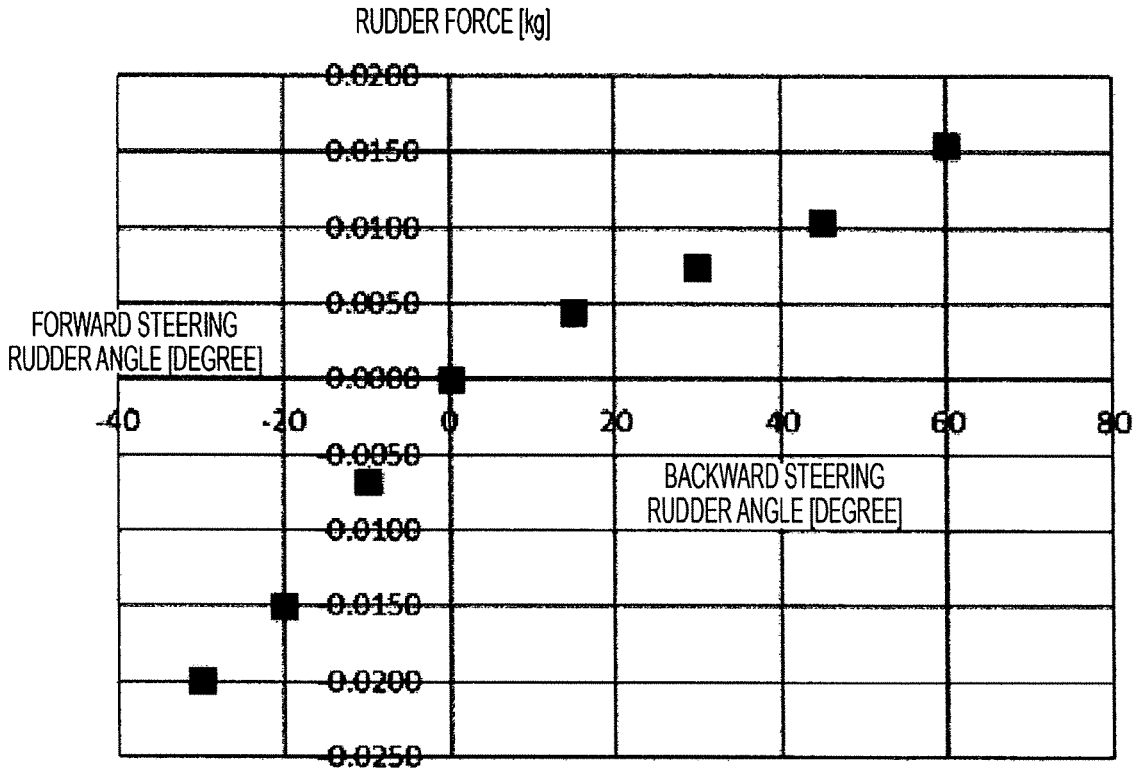
FIG. 9 is a measurement value of rudder force when steering is performed from a forward steering rudder angle to a backward steering rudder angle.

As illustrated in FIG. 9, in the case of the left rudder 2A, a rudder force generated when the left rudder shaft 10A is steered to the −rudder angle (forward steering rudder angle) to bring a posture in which the front portion of the second left rudder portion 6A is positioned on the front right side relative to the rear portion is larger than a rudder force generated when the left rudder shaft 10A is steered to the +rudder angle (backward steering rudder angle) to bring a posture in which the front portion of the second left rudder portion 6A is positioned on the front left side relative to the rear portion due to the flap effect caused by the interference between the stern and the second left rudder portion 6A.

Similarly, in the case of a left rudder 2B, a rudder force generated when the right rudder shaft 10B is steered to the −rudder angle to bring a posture in which the front portion of the second right rudder portion 6B is positioned on the front left side relative to the rear portion is larger than a rudder force generated when the right rudder shaft 10B is steered to the +rudder angle by the flap effect to bring a posture in which the front portion of the second right rudder portion 6B is positioned on the front right side relative to the rear portion due to the interference between the stern of the ship and the second right rudder portion 6B.

Figure 13:
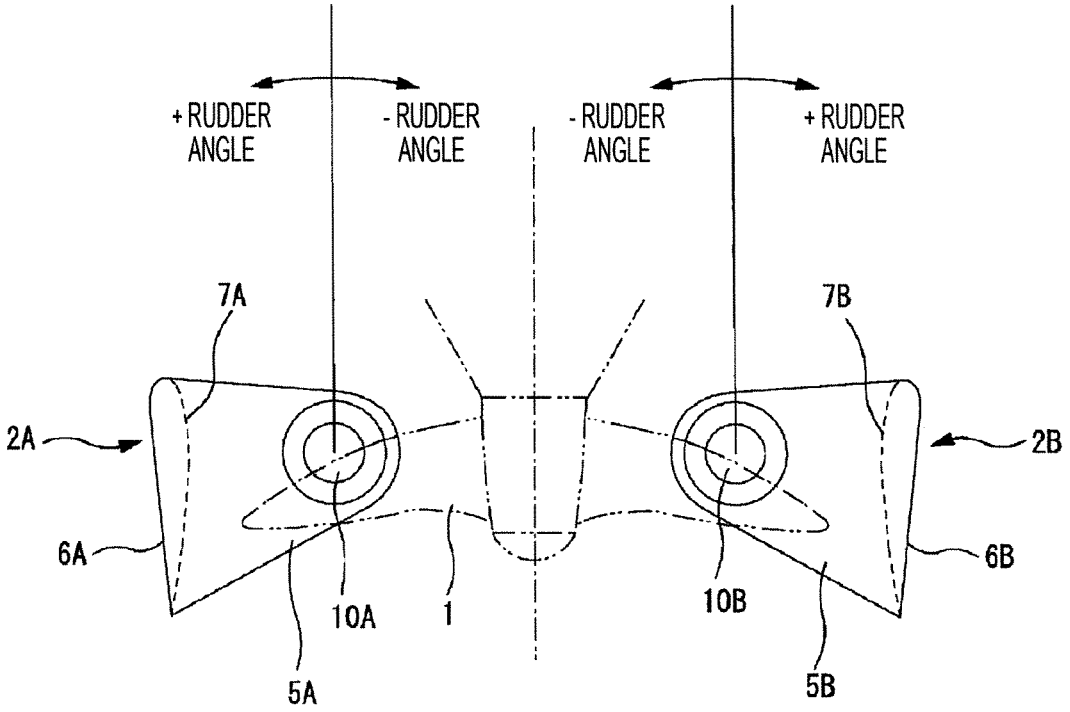
FIG. 13 is a plan view of a gate rudder.

As illustrated in FIG. 13, the −rudder angle of the left rudder shaft 10A is a rudder angle obtained by forward steering the left rudder shaft 10A in the clockwise direction, the +rudder angle of the left rudder shaft 10A is a rudder angle obtained by backward steering the left rudder shaft 10A in the counterclockwise direction, the −rudder angle of the right rudder shaft 10B is a rudder angle obtained by forward steering the right rudder shaft 10B in the counterclockwise direction, and the right rudder shaft 10B+rudder angle is a rudder angle obtained by backward steering the right rudder shaft 10B in the clockwise direction.

On the other hand, when the −rudder angle of the left rudder shaft 10A is excessively steered to bring the front portion of the second left rudder portion 6A excessively close to the stern, a disturbance occurs in the flow field of the suction flow flowing to the propeller 1, and there is a possibility that cavitation that causes vibration and noise increases. Therefore, it is preferable to set the maximum steering rudder angle of the −rudder angle of the left rudder shaft 10A to 15 degrees at which the rudder force same as the rudder force generated when the rudder is steered to the +rudder angle of 25 degrees can be obtained. Although the rotation angle of the left rudder shaft 10A can be arbitrarily set, in the present embodiment, the rotation angle is set to 0 to 15 degrees for the −rudder angle and 0 to 105 degrees for the +rudder angle.

Similarly, when the −rudder angle of the right rudder shaft 10B is excessively steered to bring the front portion of the second right rudder portion 6B excessively close to the stern, disturbance occurs in the flow field of the suction flow flowing into the propeller 1, and there is a possibility that cavitation that causes vibration and noise increases. Therefore, it is preferable to set the maximum steering rudder angle of the −rudder angle of the right rudder shaft 10B to 15 degrees at which the rudder force same as the rudder force generated when the rudder is steered to the +rudder angle of 25 degrees can be obtained. Note that the rotation angle of the right rudder shaft 10B can be arbitrarily set, but in the present embodiment, the rotation angle is set to 0 to 15 degrees for the −rudder angle and 0 to 105 degrees for the +rudder angle.

In the case of stopping the ship, by steering the left rudder shaft 10A to the −rudder angle of 15 degrees and steering the right rudder shaft 10B to the −rudder angle of 15 degrees, it is possible to block the water flow from the front side of the hull, which promotes the idling of the propeller, and it is possible to reduce the inertia force of the propeller. Therefore, in particular, in the case of FPP (fixed pitch propeller), the ship is easily shifted to the state of reverse rotation, and the stopping performance and the reverse performance can be improved.

The clearance T between the outer peripheral line L of the propeller 1 and the inner face 7 of the second rudder portion 6 can be calculated from Equation 9.

$$T = \frac{Rp + Cp * \sin(\phi) - Rp * \cos(\phi)}{\cos(\phi)} \quad \text{[Equation 9]}$$

where, Rp is a rotation radius of the second rudder portion 6, Cp is a value obtained by dividing the length between the front edge of the second rudder portion 6 and the rudder shaft by the rudder chord length C in the side view (set to 0.3 to 0.5 in the present embodiment), and ψ is the steering rudder angle of the −rudder angle of the rudder shaft 10 (set to 15 degrees in the present embodiment).

Figure 10:
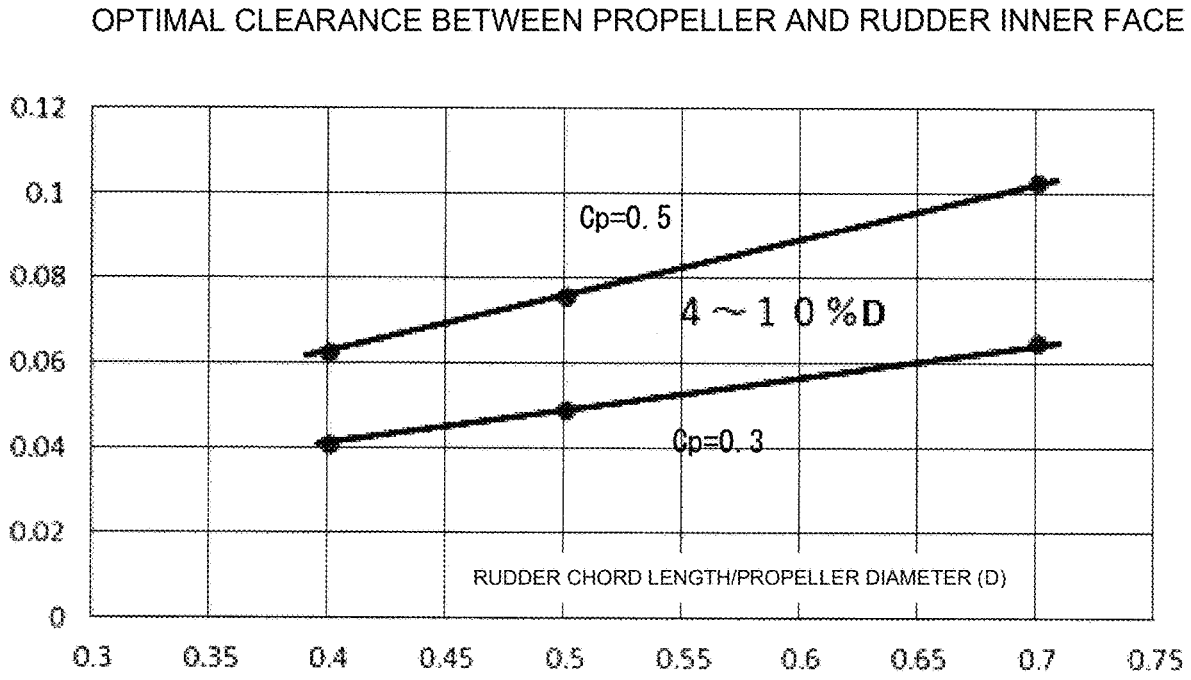
FIG. 10 is a simulation of the optimal clearance between the propeller and the gate rudder at Cp=0.3 and Cp=0.5.

As shown in FIG. 10, the clearance T calculated by substituting Cp=0.3 into Equation 9 and increasing the value obtained by dividing the rudder chord length C of the second rudder portion 6 by the diameter D of the propeller 1 to 0.4 to 0.7 is 0.04 D to 0.06 D, and the clearance T calculated by substituting Cp=0.5 into Equation 9 and increasing the value obtained by dividing the rudder chord length C of the second rudder portion 6 by the diameter D of the propeller 1 to 0.4 to 0.7 is 0.06 D to 0.1 D. Therefore, the clearance T between the outer peripheral line L of the propeller 1 and the inner face 7 of the second rudder portion 6 is preferably 4 to 10% of the diameter D of the propeller 1.

As a result, when the ship travels straight, a large rudder force due to the Coanda effect generated in the front portion of the second left rudder portion 6A extending forward of the propeller 1 by the suction flow flowing into the propeller 1 and a large rudder force due to the USB effect generated in the rear portion of the second left rudder portion 6A extending rearward of the propeller 1 by the jet ejected from the propeller 1 are generated, and a large thrust (lift) for moving the ship forward can be generated. In addition, by forming the clearance T larger than 0.03 D which is the clearance of the duct propeller, it is possible to prevent the occurrence of cavitation erosion occurring in the front portion of the inner face A of the second rudder portion 6.

Figure 11:
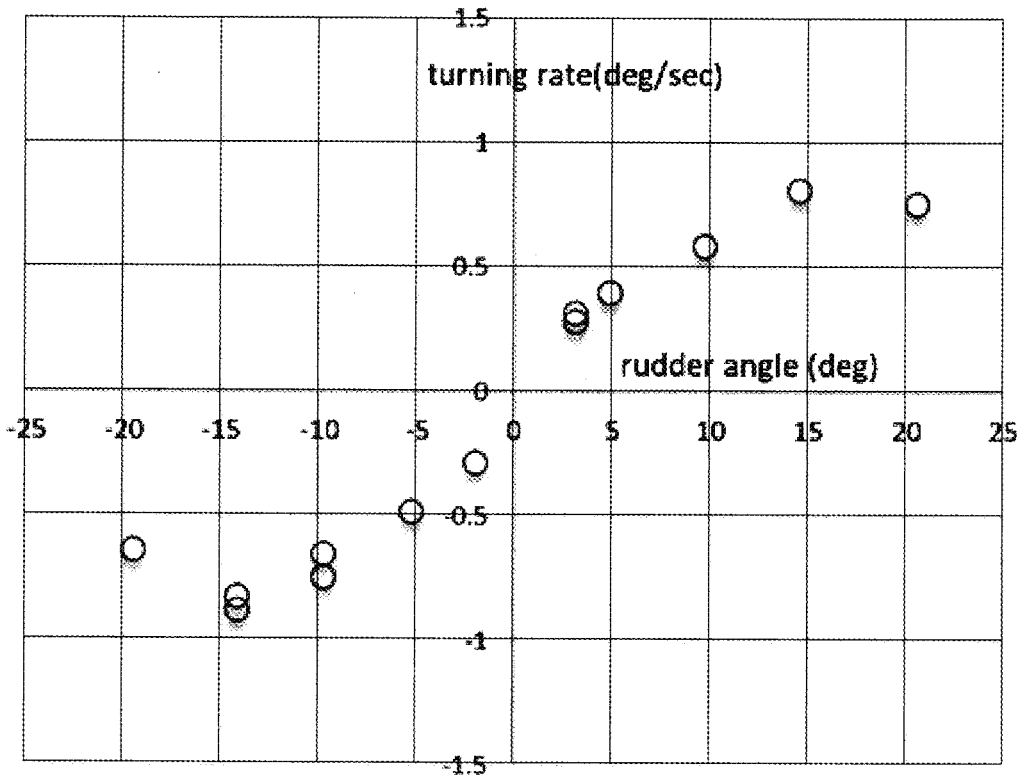
FIG. 11 is a measurement value of a normal rudder of a turning angular velocity at the time of turning of the ship.
Figure 12:
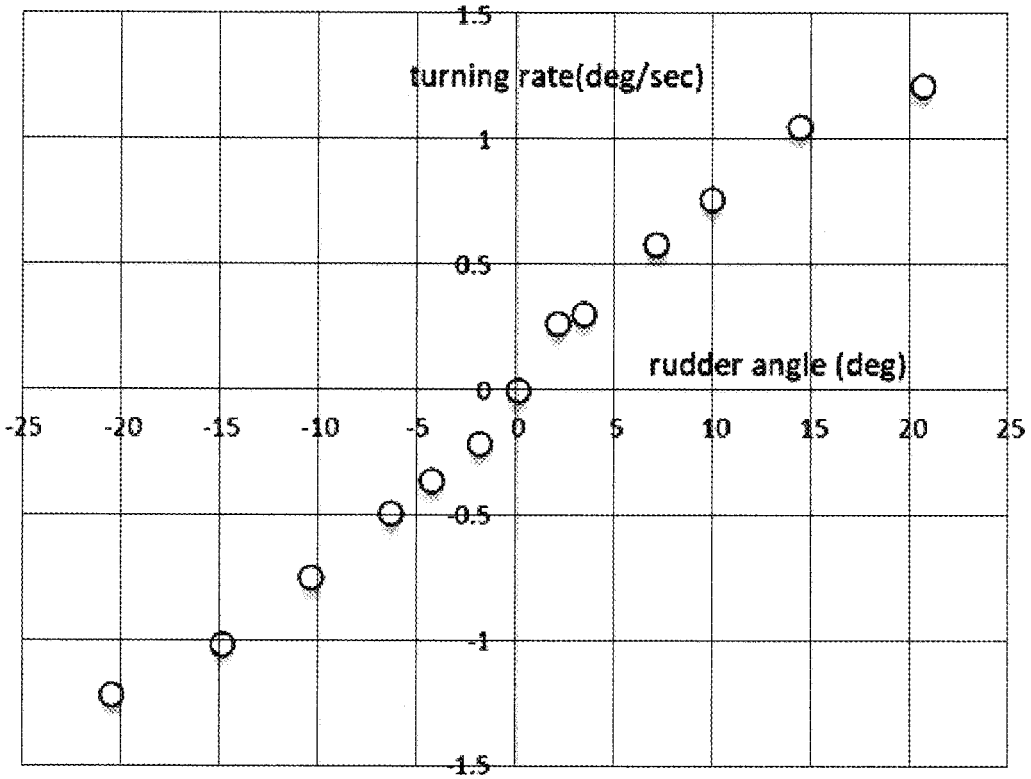
FIG. 12 is a measurement value of a gate rudder of a turning angular velocity at the time of turning of the ship.

As shown in FIGS. 11 and 12, in a normal rudder equipped behind the propeller, particularly behind the CPP (variable pitch propeller), when the steering rudder angles of the −rudder angle and the +rudder angle are 20 degrees or more, the turning force (turning angular velocity) of the ship tends to stall. On the other hand, even when the steering rudder angles of the −rudder angle and the +rudder angle are 20 degrees or more, the gate rudder can maintain the increasing tendency of the turning force (turning angular velocity) according to the rudder angle without stalling. Note that, in FIG. 11, the gate rudder of the present embodiment is denoted as gate rudder, the normal rudder is denoted as Flap Rudder, the horizontal axis indicates the rudder angle, and the vertical axis indicates the turning angular velocity.

As illustrated in FIG. 12, in plan view, the second left rudder portion 6A is formed in an airfoil shape having a curved line connecting the center of the second left rudder portion 6A in the thickness direction and bulging toward the propeller (camber line). As a result, in particular, the lift toward the front propeller is generated, the suction flow by the propeller 1 generated on the front edge of the inner face 7A of the second left rudder portion 6A generates the Coanda effect, and the lift and the rudder force corresponding thereto can be increased.

Similarly, in plan view, the second right rudder portion 6B is formed in an airfoil shape having a camber line connecting the center of the second right rudder portion 6B in the width direction and bulging toward the propeller. As a result, in particular, the lift toward the front propeller side is generated, the suction flow by the propeller 1 generated on the front edge of the inner face 7B of the second right rudder portion 6B generates the Coanda effect, and the lift and the rudder force corresponding thereto can be increased.

<Torsion Angle>

Figure 14:
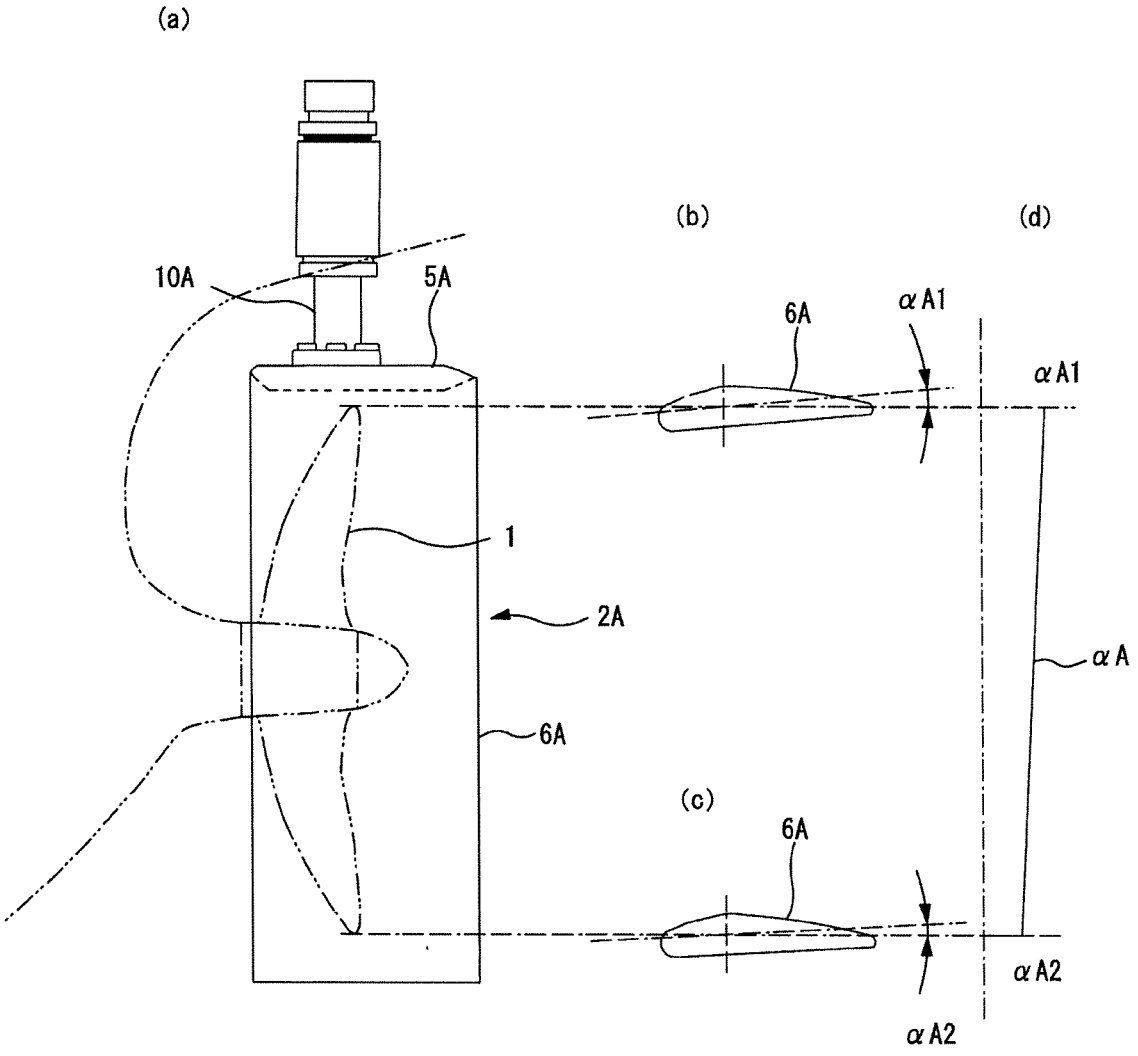
FIG. 14 illustrates a gate rudder where (a) is a left side view of the left rudder, (b) is a transverse cross-sectional view of the upper portion of the left rudder, (c) is a transverse cross-sectional view of the lower portion of the left rudder, and (d) is an explanatory view of a torsion angle of the left rudder.

As illustrated in FIG. 14, the second left rudder portion 6A has a left torsion angle αA such that the front portion of the second left rudder portion 6A is located left of the virtual line and the rear portion of the second left rudder portion 6A is located right of the virtual line with respect to the virtual line in the front-rear direction. As a result, since the suction flow flowing to the propeller 1 and the jet ejected from the propeller 1 can flow with a predetermined attack angle with respect to the rudder chord line of the second left rudder portion 6A, the second left rudder portion 6A can reduce its resistance and increase its lift. A thrust force for propelling the ship forward can be increased. Note that the second left rudder portion 6A illustrated in FIG. 12 has a torsion angle αA over the entire length of the rudder chord length of the second left rudder portion 6A, but the torsion angle αA can be formed only in the front portion of the second left rudder portion 6A forward of the left rudder shaft 10A in side view.

An upper left torsion angle αA1 of the upper portion of the second left rudder portion 6A is larger than a lower left torsion angle αA2 of the lower portion of the second left rudder portion 6A. As a result, it is possible to efficiently generate a large thrust at the upper portion of the second left rudder portion 6A facing a shallow portion of the draft of the ship having a high flow speed such as a ship suction flow, the ship having a large influence of the suction flow of the propeller as compared with the flow speed in a state where there is no propeller operation.

In FIG. 14, the entire length of the rudder chord length of the second left rudder portion 6A has the torsion angle αA, but the torsion angle αA can be formed only in the front portion of the second left rudder portion 6A forward of the left rudder shaft 10A in side view.

Figure 15:
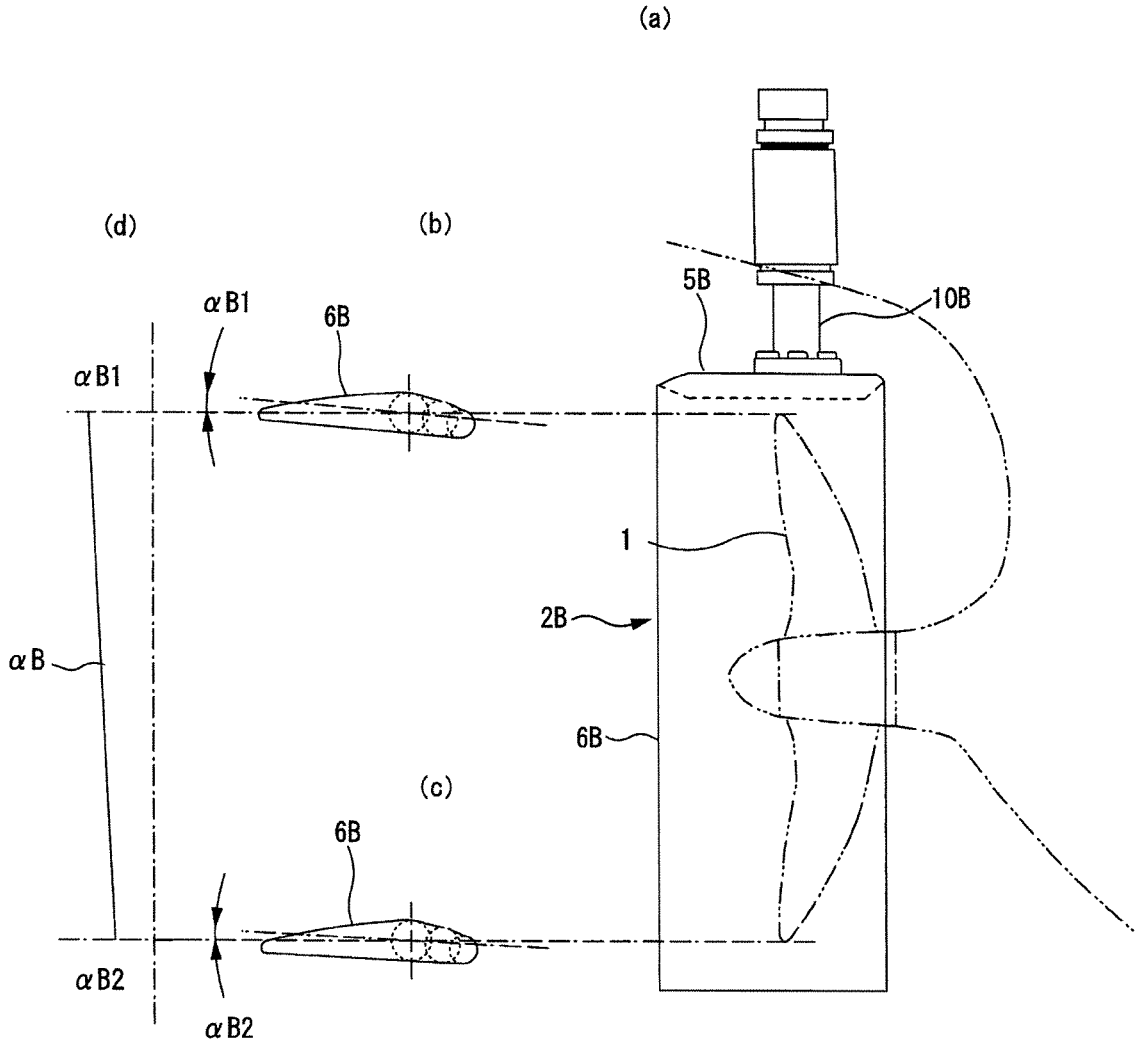
FIG. 15 illustrates a gate rudder where (a) is a right side view of the right rudder, (b) is a transverse cross-sectional view of the upper portion of the right rudder, (c) is a transverse cross-sectional view of the lower portion of the right rudder, and (d) is an explanatory view of a torsion angle of the right rudder.

Similarly, as illustrated in FIG. 15, the second right rudder portion 6B has a right torsion angle αB such that the front portion of the second right rudder portion 12 is located right of the virtual line and the rear portion of the second right rudder portion 6B is located left of the virtual line with respect to the virtual line in the front-rear direction. As a result, since the suction flow flowing into the propeller 1 and the jet ejected from the propeller 1 can flow with a predetermined attack angle with respect to the chord line of the second right rudder portion 6B, the second right rudder portion 6B can reduce its resistance and increase its lift. A thrust force for propelling the ship forward can be increased. Note that the second right rudder portion 6B illustrated in FIG. 14 has a torsion angle αB over the entire length of the rudder chord length of the second right rudder portion 6B, but the torsion angle αB can be formed only in the front portion of the second right rudder portion 6B forward of the right rudder shaft 10B in side view.

An upper right torsion angle αB1 of the upper portion of the second right rudder portion 6B is larger than a lower right torsion angle αB2 of the lower portion of the second right rudder portion 6B. As a result, it is possible to efficiently generate a large thrust at the upper portion of the second right rudder portion 6B facing a shallow portion of the draft of the ship having the large influence of the suction flow of the propeller compared with the flow velocity in a state where there is no propeller operation.

In the present specification, the torsion angle αA and the torsion angle αB are collectively referred to as a torsion angle α, the torsion angle αA1 and the torsion angle αB1 are collectively referred to as an upper torsion angle α1, and the torsion angle αA2 and the torsion angle αB2 are collectively referred to as a lower torsion angle α2.

In the gate rudder of the present embodiment, the upper torsion angle α1 is 3 degrees or more, and the lower torsion angle α2 is 5 degrees or less. Note that the upper torsion angle α1 and the like are different depending on the shape of the ship. In a thin ship such as a container ship, preferably, the upper torsion angle α1 is 5 degrees, and the lower torsion angle α2 is 1 degree. In a thick ship such as a tanker, preferably, the upper torsion angle α1 is 7 degrees, and the lower torsion angle α2 is 3 degrees. Therefore, when the relationship between the upper torsion angle α1 and the lower torsion angle α2 is summarized, it is preferable that the upper torsion angle α1 is larger than the lower torsion angle α2, the upper torsion angle α1 is 3 degrees or more, and the lower torsion angle α2 is 5 degrees or less.

Figure 16:
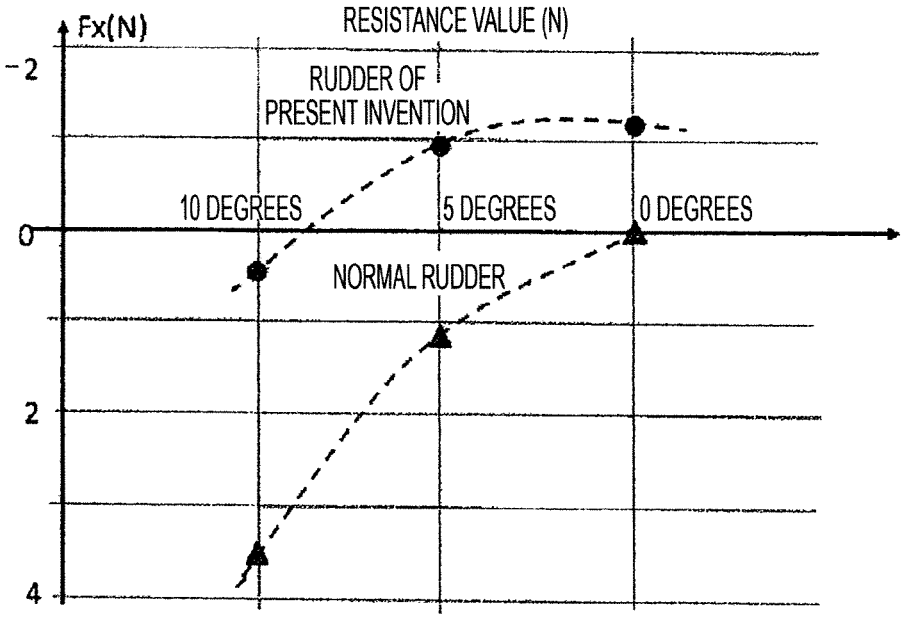
FIG. 16 is a measurement value of a resistance value in a case where a model ship equipped with a normal rudder and a model ship equipped with a gate rudder are navigated at a skew angle of 0 to 10 degrees.

As illustrated in FIG. 16, when the ship swings due to the influence of waves and wind, the rudder resistance of the gate rudder of the present embodiment is smaller than that of a normal rudder. In addition, it has been found that when the skew angle of the ship is 0 to 9 degrees, the rudder resistance of the gate rudder acts as a thrust that pushes the ship forward. As a result, it has been found that there is an effect of greatly reducing energy consumption during the voyage of the ship in the case of using the gate rudder of the present embodiment. In FIG. 16, the gate rudder of the present embodiment is denoted as the present invention rudder, and the normal rudder is denoted as the normal rudder.

Figure 17:
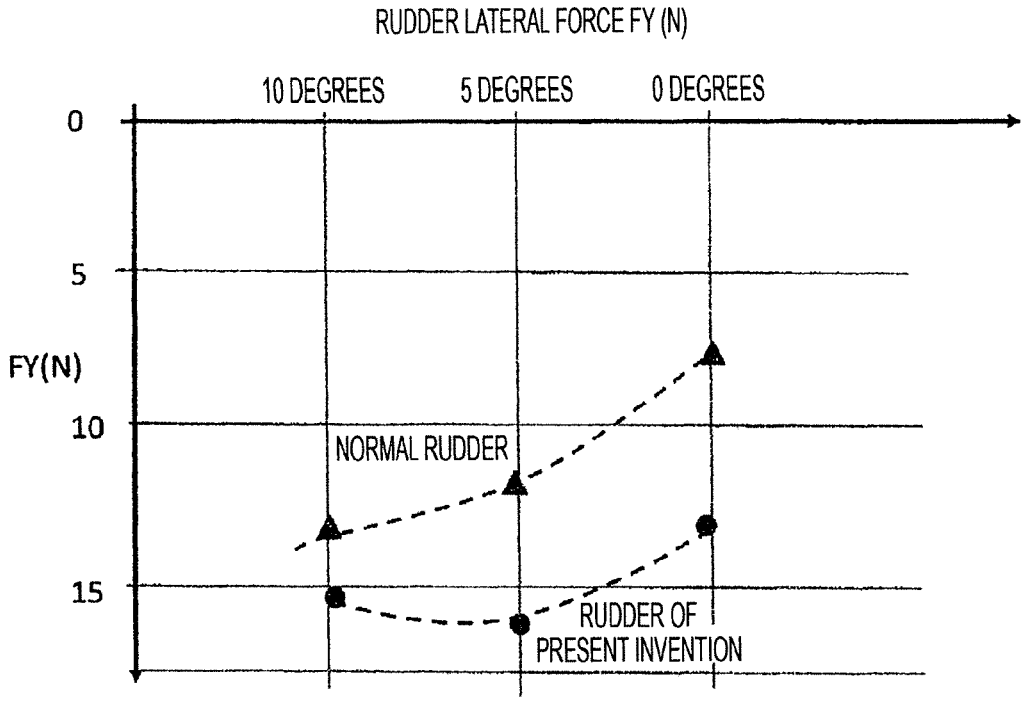
FIG. 17 is a measurement value of a rudder lateral force in a case where a model ship equipped with a normal rudder and a model ship equipped with a gate rudder are navigated at a skew angle of 0 to 10 degrees.

As illustrated in FIG. 17, it has been found that the rudder lateral force of the gate rudder of the present embodiment, that is, the restoring force for returning the ship to the straight traveling state is larger than that of the normal rudder when the ship swings due to the influence of waves and wind. As a result, it has been found that the use of the gate rudder of the present embodiment has an effect of significantly improving the course stability of the ship. In FIG. 17, the gate rudder of the present embodiment is denoted as the present invention rudder, and the normal rudder is denoted as the normal rudder.

Figure 18:
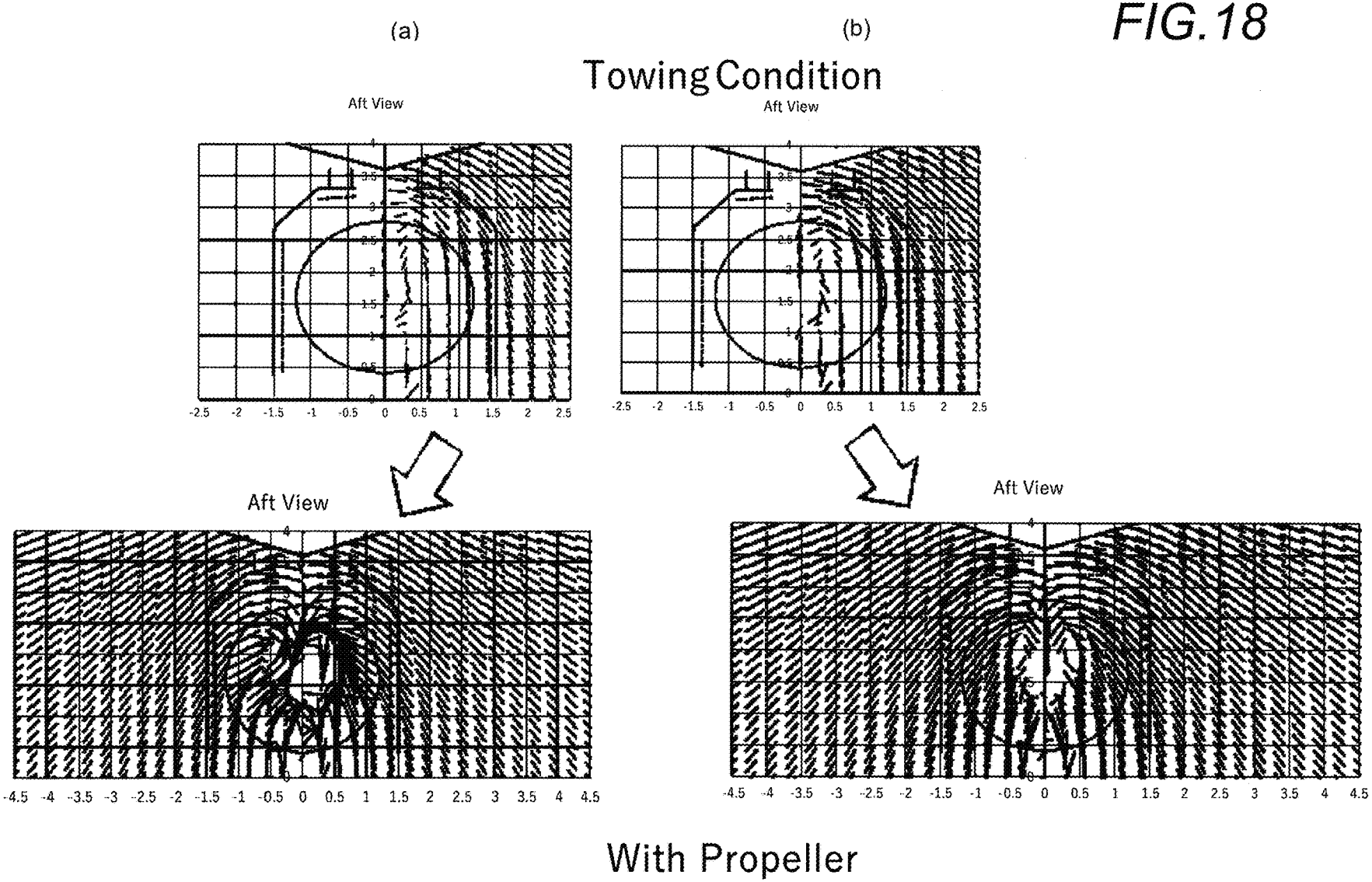
FIG. 18 illustrates simulation of disturbance of a flow field of a suction flow, where (a) represents a gate rudder in which a torsion angle is not formed, and (b) represents a gate rudder in which a torsion angle is formed.

As shown in FIG. 18, it has been found that the gate rudder in which the torsion angle α is formed in the second left rudder portion 6 suppresses disturbance of the flow field of the suction flow flowing into the propeller 1 as compared with the gate rudder in which the torsion angle is not formed in the second left rudder portion 6. As a result, it has been found that there is an effect of maintaining a large thrust by preventing a decrease in the flow velocity due to turbulence of the suction flow and preventing a decrease in the thrust generated by the gate rudder.

INDUSTRIAL APPLICABILITY

The present invention can be applied to a gate rudder including a left rudder and a right rudder disposed left and right, respectively, of a propeller of a ship.

REFERENCE SIGNS LIST

1 propeller
2 rudder
2A left rudder
2B right rudder
5 first rudder portion
6 second rudder portion
10 rudder shaft
T clearance
α torsion angle
α1 upper torsion angle
α2 lower torsion angle

The invention claimed is:

1. A gate rudder comprising a pair of rudders including a left rudder and a right rudder disposed left and right, respectively, of a propeller at a stern, wherein each of the rudders includes a first rudder portion extending in a horizontal direction and a second rudder portion linearly extending in a vertical direction in rear view, wherein a rudder chord length of the second rudder portion in a front-rear direction is 40 to 100% of a diameter of the propeller, wherein the propeller is provided within a range of 15 to 65% of the rudder chord length from a front edge of the second rudder portion in side view, and wherein a rudder shaft that drives each of the rudders is provided at a position within a range of 30 to 50% of the rudder chord length from the front edge of the second rudder portion in side view.

2. The gate rudder according to claim 1, wherein the rudder shaft that drives each of the rudders is provided at a position within a range of 35 to 45% of the rudders chord length from the front edge of the second rudder portion in side view.

3. The gate rudder according to claim 1, wherein a clearance between the propeller and the second rudder portion is 4 to 10% of the diameter of the propeller in rear view.

4. The gate rudder according to claim 1, wherein the second rudder portion is distorted, and has an upper torsion angle formed in an upper portion of the second rudder portion and a lower torsion angle formed in an upper portion of the second rudder portion, and the upper torsion angle is larger than the lower torsion angle.

5. The gate rudder according to claim 4, wherein the upper torsion angle is 3 degrees or more, and the lower torsion angle is 5 degrees or less.

6. The gate rudder according to claim 1, wherein the second rudder portion is steered forward when a ship is stopped.

7. The gate rudder according to claim 2, wherein a clearance between the propeller and the second rudder portion is 4 to 10% of the diameter of the propeller in rear view.

8. The gate rudder according to claim 2, wherein the second rudder portion is distorted, and has an upper torsion angle formed in an upper portion of the second rudder portion and a lower torsion angle formed in an upper portion of the second rudder portion, and the upper torsion angle is larger than the lower torsion angle.

9. The gate rudder according to claim 3, wherein the second rudder portion is distorted, and has an upper torsion angle formed in an upper portion of the second rudder portion and a lower torsion angle formed in an upper portion of the second rudder portion, and the upper torsion angle is larger than the lower torsion angle.

10. The gate rudder according to claim 2, wherein the second rudder portion is steered forward when a ship is stopped.

11. The gate rudder according to claim 3, wherein the second rudder portion is steered forward when a ship is stopped.

12. The gate rudder according to claim 4, wherein the second rudder portion is steered forward when a ship is stopped.

13. The gate rudder according to claim 5, wherein the second rudder portion is steered forward when a ship is stopped.

* * * * *